US010145209B2

(12) United States Patent
McGuire et al.

(10) Patent No.: US 10,145,209 B2
(45) Date of Patent: Dec. 4, 2018

(54) UTILIZING DISSOLVABLE METAL FOR ACTIVATING EXPANSION AND CONTRACTION JOINTS

(71) Applicants: Adam M. McGuire, Houston, TX (US); Jason A. Allen, Houston, TX (US)

(72) Inventors: Adam M. McGuire, Houston, TX (US); Jason A. Allen, Houston, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 757 days.

(21) Appl. No.: 14/477,561

(22) Filed: Sep. 4, 2014

(65) Prior Publication Data

US 2016/0069145 A1 Mar. 10, 2016

(51) Int. Cl.

| | |
|---|---|
| ***E21B 34/14*** | (2006.01) |
| ***E21B 43/14*** | (2006.01) |
| ***E21B 17/06*** | (2006.01) |
| ***E21B 17/18*** | (2006.01) |

(52) U.S. Cl.

CPC ..... *E21B 34/14* (2013.01); *E21B 17/06* (2013.01); *E21B 17/18* (2013.01); *E21B 43/14* (2013.01)

(58) Field of Classification Search

CPC ..... E21B 34/14; E21B 17/06; E21B 17/18; E21B 43/14

USPC ..... 166/376

See application file for complete search history.

(56) References Cited

U.S. PATENT DOCUMENTS

| | | | | |
|---|---|---|---|---|
| 5,320,178 | A * | 6/1994 | Cornette | E21B 7/00 166/278 |
| 2006/0042798 | A1* | 3/2006 | Badalamenti | E21B 21/10 166/285 |
| 2009/0025940 | A1* | 1/2009 | Rytlewski | E21B 17/06 166/378 |
| 2010/0101807 | A1* | 4/2010 | Greenlee | E21B 23/006 166/387 |
| 2012/0085548 | A1* | 4/2012 | Fleckenstein | E21B 34/063 166/373 |
| 2014/0202708 | A1* | 7/2014 | Jacob | E21B 23/01 166/376 |

* cited by examiner

*Primary Examiner* — David J Bagnell
*Assistant Examiner* — Manuel C Portocarrero
(74) *Attorney, Agent, or Firm* — Cantor Colburn LLP

(57) ABSTRACT

A system, tool and method of providing the tool downhole is disclosed. The tool is conveyed downhole on a tool string. The tool includes a first member and a second member locked in a first configuration by a locking member. The locking member is dissolvable upon introduction of a dissolving agent to the locking member. Dissolving the locking member allows motion between the second member and the first member.

17 Claims, 3 Drawing Sheets

UTILIZING DISSOLVABLE METAL FOR ACTIVATING EXPANSION AND CONTRACTION JOINTS

BACKGROUND OF THE DISCLOSURE

1. Field of the Disclosure

This disclosure relates generally to work strings deployed in wellbores for the production of hydrocarbons from subsurface formations, and in particular to a joint of a work string that may be uncoupled without causing undue stress to the members of the joint.

2. Description of the Related Art

Wellbores for hydrocarbon exploration and production can extend to great well depths, often more than 15,000 ft. Various operations may be performed at these depths, including fracturing ("fracking" or "fracing") operations, completion operations and production operations. For such operations, an assembly of a string containing at least two parts is deployed in the wellbore to a selected depth. The at least two parts are generally connected to each other and locked into a first configuration with respect to each other via shear screws while being conveyed downhole. Expansion and contraction occurs between the two connected parts in the wellbore, resulting in stress on the assembly. Once the assembly has reached its selected downhole location, shear forces are applied along the assembly, causing the shear screws to sever or break, thereby allowing the at least two parts of the assembly to move relative to each other and to alleviate stress. At deeper wellbores, longer strings are used. Thus, shear screws are required to be stronger in order to support the increased weight. However, the shear forces necessary for severing such strong shear screws may cause damage to one or more of the parts of the assembly and any other associated downhole equipment. Therefore, there is a need to unlock assemblies at a downhole location without causing damage to downhole equipment.

SUMMARY OF THE DISCLOSURE

In one aspect, the present disclosure provides a method of providing a tool downhole, the method including: conveying the tool on a tool string into a wellbore to a selected downhole location, wherein the tool includes a first member and a second member locked in a first configuration by a locking member; and dissolving the locking member to allow motion between the first member and the second member.

In another aspect, the present disclosure provides a wellbore system, including: a tool string conveyable to a downhole location in a wellbore, the tool string including a tool having a first member and a second member; and a locking member configured to maintain the first member and the second member locked in a first configuration, wherein the locking member is dissolvable upon introduction of a dissolving agent to the locking member to thereby allow motion between the second member and the first member.

In yet another aspect, the present disclosure provides a tool string for use in a wellbore, including: a first member; a second member; and a dissolvable locking member configured to maintain the first member and the second member locked in a first configuration during conveyance of the tool string to a downhole location, wherein dissolution of the locking member enables motion between the second member and the first member.

Examples of certain features of the apparatus and method disclosed herein are summarized rather broadly in order that the detailed description thereof that follows may be better understood. There are, of course, additional features of the apparatus and method disclosed hereinafter that will form the subject of the claims.

BRIEF DESCRIPTION OF THE DRAWINGS

For detailed understanding of the present disclosure, references should be made to the following detailed description, taken in conjunction with the accompanying drawings, in which like elements have been given like numerals and wherein.

DETAILED DESCRIPTION OF THE DISCLOSURE

Figure 1:
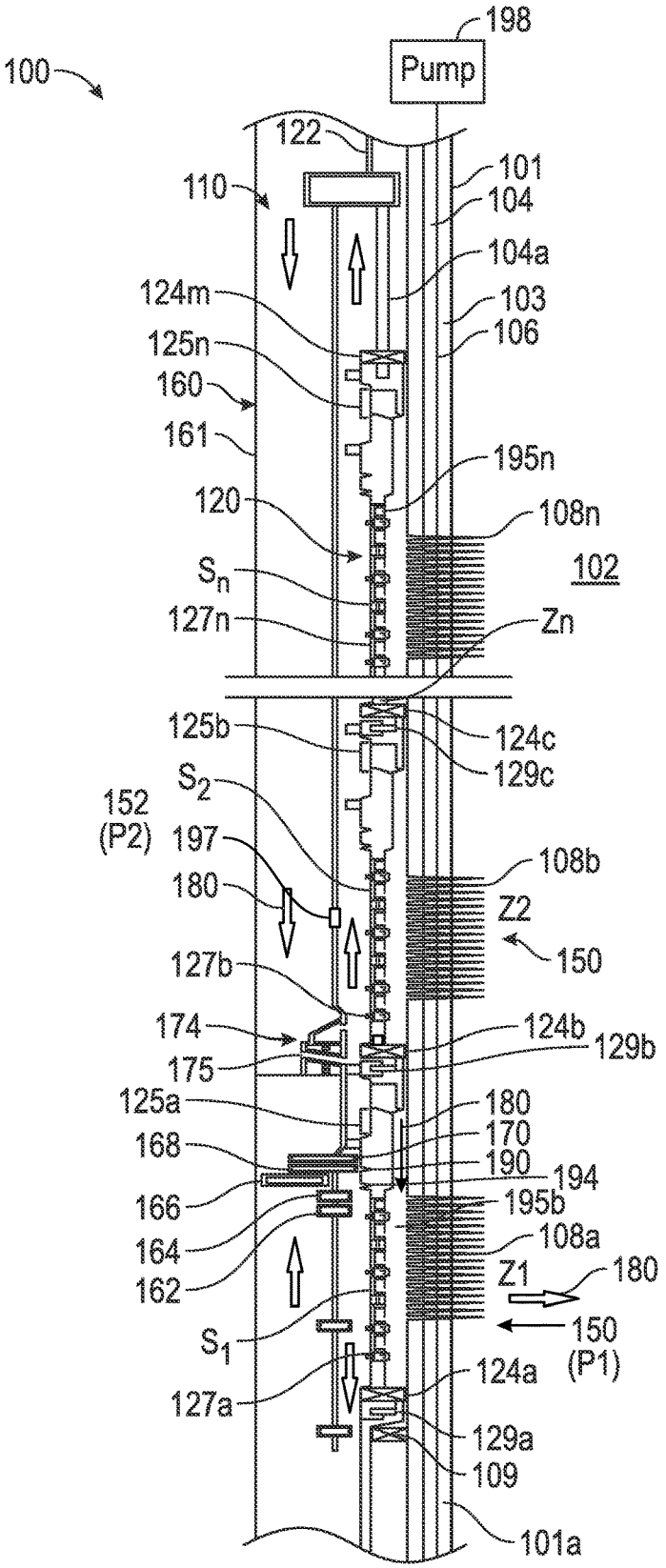
FIG. 1 is a line diagram of a section of a wellbore system that is shown to include a wellbore formed in formation for performing a treatment operation therein, such as fracturing the formation, gravel packing, flooding, etc.

FIG. 1 is a line diagram of a section of a wellbore system 100 that is shown to include a wellbore 101 formed in formation 102 for performing a treatment operation therein, such as fracturing the formation (also referred to herein as fracing or fracking), gravel packing, flooding, etc. The wellbore 101 is lined with a casing 104, such as a string of jointed metal pipes sections, known in the art. The space or annulus 103 between the casing 104 and the wellbore 101 is filled with cement 106. The particular embodiment of FIG. 1 is shown for selectively fracking and gravel packing one or more zones in any selected or desired sequence or order. However, wellbore 101 may be configured to perform other treatment or service operations, including, but not limited to, gravel packing and flooding a selected zone to move fluid in the zone toward a production well (not shown). The formation 102 is shown to include multiple production zones (or zones) Z1-Zn which may be fractured or treated for the production of hydrocarbons therefrom. Each such zone is shown to include perforations that extend from the casing 104, through cement 106 and to a certain depth in the formation 102. In FIG. 1, Zone Z1 is shown to include perforations 108*a*, Zone Z2 perforations 108*b*, and Zone Zn perforations 108*n*. The perforations in each zone provide fluid passages for fracturing each such zone. The perforations also provide fluid passages for formation fluid 150 to flow from the formation 102 to the inside 104*a* of the casing 104. The wellbore 101 includes a sump packer 109 proximate to the bottom 101*a* of the wellbore 101. The sump packer 109 is typically deployed after installing casing 104 and cementing the wellbore 101. After casing, cementing, sump packer deployment, perforating and cleanup operations, the wellbore 101 is ready for treatment operations, such as fracturing and gravel packing of each of the production zones Z1-Zn. The fluid 150 in the formation 102 is at a formation pressure (P1) and the wellbore 101 is filled with a fluid 152, such as completion fluid, which fluid provides hydrostatic pressure (P2) inside the wellbore 101. The hydrostatic pressure P2 is greater than the formation pressure P1 along the depth of the wellbore 101, which prevents flow of the fluid 150 from the formation 102 into the casing 104 and prevents blow-outs.

Still referring to FIG. 1, to treat (for example fracture) one or more zones Z1-Zn, a system assembly 110 is run inside the casing 104. In one non-limiting embodiment, the system assembly 110 includes an outer string 120 and an inner string 160 placed inside the outer string 120. The outer string 120 includes a pipe 122 and a number of devices associated with each of the zones Z1-Zn for performing treatment operations described in detail below. In one non-limiting embodiment, the outer string 120 includes a lower packer 124*a*, an upper packer 124*m* and intermediate packers 124*b*, 124*c*, etc. The lower packer 124*a* isolates the sump packer 109 from hydraulic pressure exerted in the outer string 120 during fracturing and sand packing of the production zones Z1-Zn. In this case the number of packers in the outer string 120 is one more than the number of zones Z1-Zn. In some cases, the lower packer 109, however, may be utilized as the lower packer 124*a*. In one non-limiting embodiment, the intermediate packers 124*b*, 124*c*, etc. may be configured to be independently deployed in any desired order so as to fracture and pack any of the zones Z1-Zn in any desired order. In another embodiment, some or all of the packers may be configured to be deployed at the same time or substantially at the same time. The packers 124*a*-124*m* may be hydraulically or mechanically set or deployed. The outer string 120 further includes a screen adjacent to each zone. For example, screen S1 is shown placed adjacent to zone Z1, screen S2 adjacent to zone Z2 and screen Sn adjacent to zone Zn. The lower packer 124*a* and intermediate packer 124*b*, when deployed, will isolate zone Z1 from the remaining zones: packers 124*b* and 124*c* will isolate zone Z2 and packers 124*m*-1 and 124*m* will isolate zone Zn. In one non-limiting embodiment, each packer has an associated packer activation device that allows selective deployment of its corresponding packer in any desired order. In FIG. 1, a packer activation/deactivation device 129*a* is associated with the lower packer 124*a*, device 129*b* with intermediate packer 124*b*, device 129*c* with intermediate packer 124*c* and device 129*m* with the upper packer 129*m*.

Still referring to FIG. 1, in one non-limiting embodiment, each of the screens S1-Sn may be made by serially connecting two or more screen sections with interconnecting connection members and fluid flow devices for allowing fluid to flow along the screen sections. The screens also include fluid flow control devices, such as sliding sleeve valves 127*a* (screen S1), 127*b* (screen S2), 127*n* (screen Sn) to provide flow of the fluid 150 from the formation 102 into the outer string 120. The outer string 120 also includes, above each screen a flow control device, referred to as a slurry outlet or a gravel exit, which may be a sliding sleeve valve or another valve, to provide fluid communication between the inside 120*a* of the outer string 120 and each of the zones Z1-Zn. As shown in FIG. 1, a slurry outlet 125*a* is provided for zone Z1 between screen S1 and its intermediate packer 124*b*, slurry outlet 125*b* for zone Z2 and slurry outlet 127*n* for zone Zn. The outer string 120 is run in the wellbore 101 with the slurry outlets (125*a*-125*n*) and flow devices 127*a*-127*n* closed. The slurry outlets and the flow devices can be opened downhole. The outer string 120 also includes a zone indicating profile or locating profile for each zone, such as profile 190 for zone Z1.

Still referring to FIG. 1, the inner string 160 (also referred to herein as the service string) includes a tubular member 161 that in one embodiment carries an opening shifting tool 162 and a closing shifting tool 164. The inner string 160 further may include a reversing valve 166 that enables the removal of treatment fluid from the wellbore 101 after treating each zone, and an up-strain locating tool 168 for locating a location uphole of the set down locations, such as location 194 for zone Z1, when the inner string is pulled uphole, and a set down tool or set down locating tool 170 is set. In one aspect, the set down tool 170 may be configured to locate each zone and then set down the inner string 160 at each such location for performing a treatment operation. The inner string 160 further includes a crossover tool 174 (also referred to herein as the "frac port") for providing a fluid path 175 between the inner string 160 and the outer string 120.

To perform a treatment operation in a particular zone, for example zone Z1, lower packer 124*a* and upper packer 124*m* are set or deployed. Setting the upper packer 124*m* and lower packer 124*a* anchors the outer string 120 inside the casing 104. The production zone Z1 is then isolated from all the other zones. To isolate zone Z1 from the remaining zones Z2-Zn, the inner string 160 is manipulated so as to cause the opening tool 164 to open a monitoring valve 127*a* in screen S1. The inner string 160 is then manipulated (moved up and/or down) inside the outer string 120 so that the set down tool 170 locates the locating or indicating profile 190. The set down tool 170 is then manipulated to cause it to set down inside the string 120. When the set down tool 170 is set, the frac port 174 is adjacent to the slurry outlet 125*a* and thereby isolating or sealing a section that contains the slurry outlet 125*a* and the frac port 174, while providing fluid communication between the inner string 160 and the slurry outlet 125*a*. The packer 124*b* is then set to isolate zone Z1 unless previously set. Once the packer 124*b* has been set, frac sleeve 125*a* is opened, as shown in FIG. 1, to supply slurry or another fluid to zone Z1 to perform a fracturing or a treatment operation as shown by arrows 180. When the outer string 120 and inner string 160 are deployed in the wellbore 101, the temperature inside the wellbore 101 is close to the formation temperature. During a treatment operation, a fluid or slurry, such as a combination of water and guar along with proppant (typically sand), is supplied from the surface, which fluid is at a surface temperature substantially below the downhole temperature. This lower temperature can cause the outer string 120 to undergo changes in length. Once the treatment operations have been completed, the outer string 120 again may undergo length changes due to higher downhole temperature. The disclosure herein, in one aspect, provides an expansion tool (also referred to herein as the expansion joint) to accommodate for the changes in the outer string length. In one aspect, an expansion tool is placed below certain packers, such as an expansion tool 195*b* below packer 124*b*, expansion tool 195*c* below packer 124*c* and expansion tool 195*m* below packer 124*m*. In some situations, the inner string 160 can become stuck inside the outer string 120 due to excessive amount of sand settling near the frac port which prevents removal of the inner string 160 from the outer string without secondary operations.

The wellbore system 100 may include a pump system 198 that pumps a fluid or dissolving agent into the wellbore 101. The pumped dissolving agent is chemically reactive with certain elements of the wellbore system 100 such as shear screws or other locking elements that hold the inner string 160 and outer string 120 in a first configuration while being conveyed downhole. The dissolving agent may be pumped into the wellbore 101 once the system assembly 110 has been run into the wellbore 101 and dissolves the shear screws and/or locking elements to allow movement between components of the system assembly 110, as discussed below.

While FIG. 1 discloses a wellbore system 100 suitable for a fracturing operation, the present disclosure may be used other downhole operations, such as a production operation, a completion operation, etc.

Figure 2:
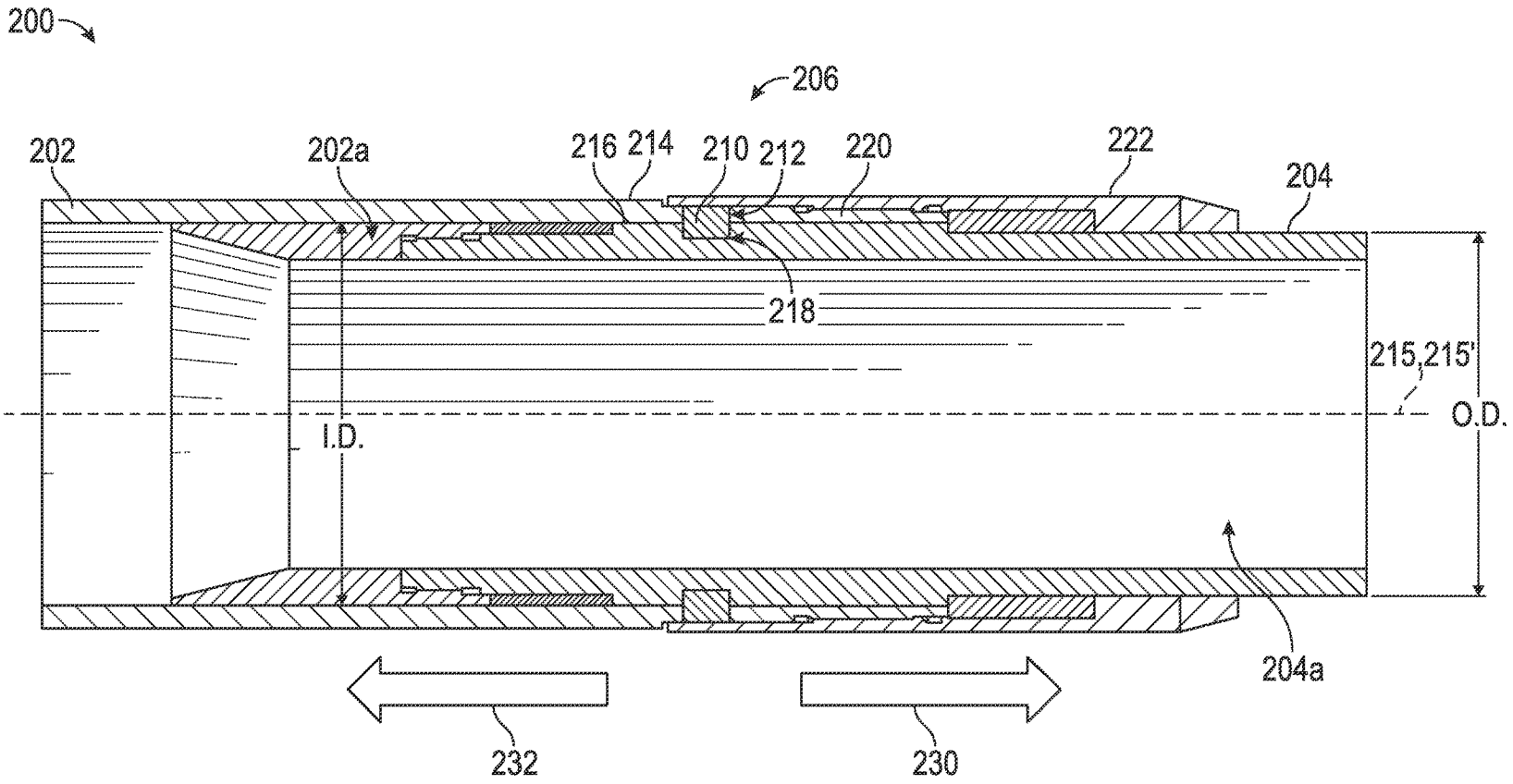
FIG. 2 shows an illustrative section or joint of a tool string for performing a downhole operation in one embodiment of the present disclosure.

FIG. 2 shows an illustrative section or joint of a tool string 200 for performing a downhole operation in one embodiment of the present disclosure. The tool string 200 string includes a first member 202 and a second member 204. In one embodiment, the first member 202 may be a member of an outer string assembly and the second member 204 may be part of an inner string assembly. Alternatively, the first member 202 and the second member 204 may both be part of an outer string assembly. In another alternate embodiment, the first member 202 and the second member 204 may both be part of an inner string assembly. The first member 202 and the second member 204 may be part of a tool conveyed by the tool string 200. The first member 202 may be an upper housing and the second member 204 may be a lower housing, or vice versa. The first member 202 and the second member 204 be connected at a joint 206, wherein a second portion 204*a* of the second member 204 may move within a first portion 202*a* of the first member 202 at the joint 206. In one embodiment, the first portion 202*a* includes a hollow tubular having a longitudinal axis 215 and an inner diameter (I.D.). The second portion 204*a* may further include a hollow tubular having a longitudinal axis 215' and at least an outer diameter (O.D.). The longitudinal axis 215 of first member 202 is aligned with the longitudinal axis 215' of the second member 204 when the first portion 202*a* is joined with the second portion 204*a*. The outer diameter of the second portion 204*a* is equal to or slightly less than the inner diameter of the first portion 202*a* to allow the second portion 204*a* to the move relative to the first portion 202*a* along the shared longitudinal axes (215, 215').

The first member 202 and the second member 204 may be held in place or locked in place with respect to each other via a locking member 210. In various embodiments, the locking member 210 may include a bearing, a lug, a screw, a collet, a sleeve, a dog or other member suitable for use with the illustrative joint 206. The locking member 210 may be a load-bearing member, such that the locking member 210 bears the load of the lower of the first member 202 and the second member 204 in the wellbore as well as any additional weights or forces. The first member 202 may include a gap or hole 212 that passes through a wall of the first member 202 from an outer surface 214 of the first member 212 to an inner surface 216 of the first member 202. The second part 204 may include a notch 218 or groove in its outer surface 220. As shown in FIG. 2, the gap 212 of the first member 202 and the notch 218 of the second member 204 may be aligned and the locking member 210 may be disposed within the gap 212 and the notch 218 in order to maintain or lock the first member 202 and the second member 204 in a first configuration. Sleeve 222 associated with the first member 202 may be moved to various locations along the longitudinal axis of the first member 202 in order to either expose or cover the locking member 210. As shown in FIG. 2, the sleeve 222 seals the locking member 210 from a downhole wellbore environment. Additionally, the sleeve 222 maintains the locking member 210 in place within the gap 212 and the notch 218, thereby preventing the locking member 210 from dislodging from notch 218. In various embodiments, the tool string 200 is maintained in a first configuration (as shown in FIG. 2) with the locking member 210 in place while the tool string 206 is conveyed downhole.

Moving the sleeve 222 longitudinally away from the first member 202 exposes the load-bearing member 210 to the wellbore. A dissolving agent may be pumped downhole using the pump (198, FIG. 1) to the selected location of the joint 206. The dissolving agent interacts with the locking member 210. In one embodiment, the dissolving agent includes an acid that is chemically reactive with the material composition of the locking member 210 and therefore disintegrates or dissolves the locking member 210. The first member 202 and the second member 204 as well as other components shown in FIG. 2 (except for the locking member 210) may be made of material that is unreactive with the dissolving agent. Once the locking member 210 has been dissolved, the first member 202 and the second member 204 are free to move relative to each other along the longitudinal axis (215, 215'). Alternatively, the tool string 200 may be conveyed through a dissolving agent that is already present in the wellbore. The dissolving agent may therefore be brine in the wellbore.

In various embodiments, joint 206 may be an expansion joint or a contraction joint. The locking member 210 maintains the first member 202 and the second member 204 in a first configuration in which the second member 204 is at a first position with respect to the first member 202. For an expansion joint, once the locking member 210 has been dissolved, the second member 204 may be moved as shown by directional arrow 230 with respect to the first member 202 to a second configuration in which the first member 202 and the second member 204 are farther apart than when in the first configuration. For a contraction joint, once the locking member 210 is dissolved, the second member 204 may be moved as shown by directional arrow 232 with respect to the first member 202 to a second configuration in which the first member 202 and the second member 204 are closer together than when in the first configuration. In one embodiment, a downhole operation may be performed that moves the first member 202 and the second member 204 from the first configuration to a second configuration. In an alternate embodiment, the operation or a stage of the operation may be automatically enabled when the first member 202 and the second member 204 are placed in the second configuration. Alternately, an operator may enable the operation or the stage of the operation upon recognizing that the first member 202 and the second member 204 are in the second configuration. In another embodiment, the first member 202 and the second member 204 may be free to move with respect to each other, rather than being maintained at a selected position with respect to each other. In this embodiment with a free motion between the first member 202 and the second member 204, the downhole operation or a stage of the downhole operation may produce motion between the first member 202 and the second member 204. The produced motion may be periodic motion, semi-periodic motion, continuous motion, axial motion, etc., or other motion that does not employ a specific configuration of the first member 202 and the second member 204 or a specific relative location of the first member 202 and the second member 204 with respect to each other.

Figure 3:
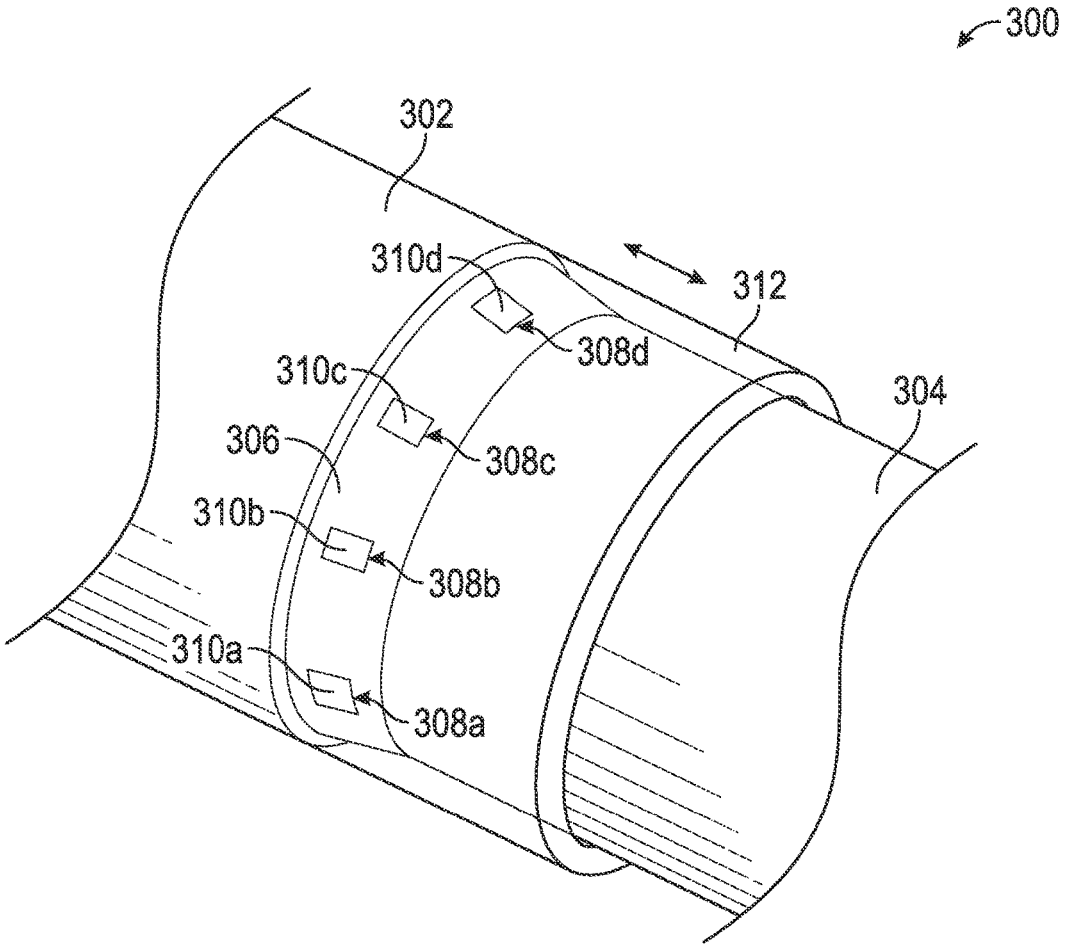
FIG. 3 shows a rotational joint of a tool string in another embodiment of the present disclosure.

FIG. 3 shows a rotational joint 300 of a tool string in another embodiment of the present disclosure. The rotational joint 300 includes a first member 302 and a second member 304. The first member 302 and the second member 304 are tubular members in one embodiment. An inner diameter of the first member 302 is equal to or greater than an outer diameter of the second member 304 so that at least a portion of the second member 304 may be placed inside the first member 302, wherein the first member 302 and the second member 304 may be rotatable with respect to each other.

The first member 302 includes a perforated end 306 that includes various holes 308*a*, 308*b*, 308*c* and 308*d*. The second member 304 also includes an end (not shown) that may include holes or notches formed therein. When the first member and the second member are mated in a first configuration, the holes 308*a-d* of the first member 302 are aligned with the notches of the second member 304. Locking members 310*a-d* may then be inserted into respective holes 308*a-d* and their corresponding notches to prevent rotation of the first member 302 with respect to the second member 304. A protective sleeve 312 may be moved along the over the locking member 310*a-d* to protect the locking members 310*a-d* form the downhole environment. Once the joint 300 has been conveyed downhole to a selected location, the sleeve 312 may be moved axially to expose the locking members 310*a-d* to the downhole environment. A dissolving agent may then be pumped downhole to the selected location in order to dissolve the locking members 310*a-d*, thereby freeing the first member 304 and the second member 306 to rotate relative to each other.

Therefore in one aspect, the present disclosure provides a method of providing a tool downhole, the method including: conveying the tool on a tool string into a wellbore to a selected downhole location, wherein the tool includes a first member and a second member locked in a first configuration by a locking member; and dissolving the locking member to allow motion between the first member and the second member. The first member may be an upper housing of the tool string and the second member may be a lower housing of the tool string. In various embodiments, the locking member may be a bearing, a lug, a screw, a collet, a sleeve, a dog, etc. Dissolving the locking member may include introducing a dissolving agent to the locking member at the downhole location, and/or conveying the tool through dissolving agent already present in the wellbore. The tool may be used to performing a downhole operation such as a frac operation, a production operation, a completion operation, etc. In one embodiment, performing the downhole operation may include moving the first member and the second member to a second configuration. In another embodiment, performing the downhole operation may include unrestricted motion between the first member and the second member.

In another aspect, the present disclosure provides a wellbore system, including: a tool string conveyable to a downhole location in a wellbore, the tool string including a tool having a first member and a second member; and a locking member configured to maintain the first member and the second member locked in a first configuration, wherein the locking member is dissolvable upon introduction of a dissolving agent to the locking member to thereby allow motion between the second member and the first member. In various embodiments, the locking member may be a bearing, a lug, a screw, a collet, a sleeve, a dog, etc. A pump may be used to introduce the dissolving agent to the locking member at the downhole location. Alternatively, the tool string may be conveyed through dissolving agent present in the wellbore. The first member may be an upper housing of the tool string and the second member may be a lower housing of the tool string. The tool may perform a downhole operation such as a frac operation, a production operation, a completion operation, etc. In one embodiment, the tool may perform the downhole operation by moving the first member and the second member to a second configuration. Alternatively, the tool may perform the downhole operation by producing a motion between the first member and the second member.

In yet another aspect, the present disclosure provides a tool string for use in a wellbore, including: a first member; a second member; and a dissolvable locking member configured to maintain the first member and the second member locked in a first configuration during conveyance of the tool string to a downhole location, wherein dissolution of the locking member enables motion between the second member and the first member. In various embodiments, the locking member may be a bearing, a lug, a screw, a collet, a sleeve, a dog, etc. A pump may be used to introduce the dissolving agent to the locking member at the downhole location. Alternatively, the tool string may be conveyed through dissolving agent present in the wellbore. The first member may be an upper housing of the tool string and the second member may be a lower housing of the tool string. The tool may perform a downhole operation such as a frac operation, a production operation, a completion operation, etc. The tool string may perform a downhole operation using an operation that is enabled by the first member and the second member being in a second configuration and/or by using motion between the first member and the second member. In one embodiment, the tool string may perform the downhole operation by moving the first member and the second member from the first configuration to a second configuration. Alternatively, the tool string may perform a downhole operation that produces a motion between the first member and the second member during the operation without moving the first member and the second to a specific configuration or relative location with respect to each other.

While the foregoing disclosure is directed to the certain exemplary embodiments of the disclosure, various modifications will be apparent to those skilled in the art. It is intended that all variations within the scope and spirit of the appended claims be embraced by the foregoing disclosure.

The invention claimed is:

1. A method of providing a tool downhole, comprising:

conveying the tool on a tool string into a wellbore to a selected downhole location, wherein the tool includes a first tubular member having a hole passing through a wall of the first tubular member, a second tubular member having a notch at its outer surface and a locking member extending through the hole of the first tubular member and into the notch of the second tubular member to maintain the first tubular member and the second tubular member in a first configuration;

pumping a dissolving agent to the downhole location to dissolve the locking member; and moving the second tubular member within the first tubular member relative to the downhole location.

2. The method of claim 1, wherein the locking member is at least one of: (i) a bearing; (ii) a lug; (iii) a screw; (iv) a collet; (v) a sleeve; and (vi) a dog.

3. The method of claim 1, wherein the first tubular member is an upper housing of the tool string and the second tubular member is a lower housing of the tool string.

4. The method of claim 1, further comprising performing a downhole operation using the tool, wherein the downhole operation is one of: (i) a frac operation; (ii) a production operation; and (iii) a completion operation.

5. The method of claim 4, wherein performing the downhole operation further comprises moving the first tubular member and the second tubular member to a second configuration.

6. The method of claim 4, wherein performing the downhole operation further comprises producing motion between the first tubular member and the second tubular member.

7. A wellbore system, comprising:

a tool string conveyable to a downhole location in a wellbore, the tool string including a tool having a first tubular member having a hole passing through a wall of the first tubular member and a second tubular member having a notch in its outer surface;

a locking member configured to extend through the hole of the first tubular member and into the notch of the second tubular member maintain the first member and the second member locked in a first configuration, wherein the locking member is dissolvable upon introduction of a dissolving agent to the locking member and wherein the second member moves within the first member relative to the downhole location when the locking member is dissolved; and a pump configured to pump the dissolving agent to the downhole location to dissolve the locking member.

8. The system of claim 7, wherein the locking member is at least one of: (i) a bearing; (ii) a lug; (iii) a screw; (iv) a collet; (v) a sleeve; and (vi) a dog.

9. The system of claim 7, wherein the first tubular member is an upper housing of the tool string and the second tubular member is a lower housing of the tool string.

10. The system of claim 7, wherein the tool is configured to perform a downhole operation that is at least one of: (i) a frac operation; (ii) a production operation; and (iii) a completion operation.

11. The system of claim 10, wherein the tool performs the downhole operation by moving the first tubular member and the second tubular member to a second configuration.

12. The system of claim 10, wherein the tool performs the downhole operation via producing a motion between the first tubular member and the second tubular member.

13. A tool string for use in a wellbore, comprising:

a first tubular member having a hole passing through a wall of the first tubular member;

a second member having a notch in its outer surface;

a dissolvable locking member configured to maintain the first member and the second member locked in a first configuration and bear a load of the lower of the first tubular member and the second tubular during conveyance of the tool string to a downhole location, wherein the second member moves within the first member relative to the downhole location when the locking member is dissolved; and a pump configured to pump a dissolving agent to the downhole location to dissolve the locking member.

14. The tool string of claim 13, wherein the locking member is at least one of: (i) a bearing; (ii) a lug; (iii) a screw; (iv) a collet; (v) a sleeve; and (vi) a dog.

15. The tool string of claim 13, wherein the first tubular member is an upper housing of the tool string and the second tubular member is a lower housing of the tool string.

16. The tool string of claim 13, wherein tool string is configured for use in at least one of: (i) a frac operation; (ii) a production operation; and (iii) a completion operation.

17. The tool string of claim 13, wherein the tool string is configured to perform a downhole operation by performing at least one of: (i) an operation that moves the first tubular member and the second tubular member from the first configuration to a second configuration; and (ii) an operation that produces a motion between the first tubular member and the second tubular member during the operation.

* * * * *